US005842419A

United States Patent [19]

Puschnerat

[11] Patent Number: 5,842,419

[45] Date of Patent: Dec. 1, 1998

[54] PLATE END EJECTOR FOR PLATE CYLINDER

[75] Inventor: Helmut Puschnerat, Wachenheim, Germany

[73] Assignee: Koenig & Bauer-Albert Aktiengesellschaft, Wurzburg, Germany

[21] Appl. No.: 924,085

[22] Filed: Sep. 5, 1997

[30] Foreign Application Priority Data

Sep. 7, 1996 [DE] Germany ..... 196 36 412.4

[51] Int. Cl.[6] ..... B41F 27/12

[52] U.S. Cl. ..... 101/483; 101/415.1

[58] Field of Search ..... 101/415.1, 389.1, 101/483

[56] References Cited

U.S. PATENT DOCUMENTS

| | | | |
|---|---|---|---|
| 5,255,604 | 10/1993 | Dürr | 101/389.1 |
| 5,335,046 | 8/1994 | Bosy | 101/415.1 |
| 5,461,981 | 10/1995 | Schneider | 101/415.1 |
| 5,526,746 | 6/1996 | Capdeboscq | 101/415.1 |
| 5,622,111 | 4/1997 | Bachmeir et al. | 101/415.1 |
| 5,653,170 | 8/1997 | Puschnerat et al. | 101/415.1 |
| 5,687,647 | 11/1997 | Vrotocoe et al. | 101/415.1 |
| 5,715,753 | 2/1998 | Hachiya | 101/415.1 |

FOREIGN PATENT DOCUMENTS

| | | |
|---|---|---|
| 0 686 503 | 12/1995 | European Pat. Off. . |
| 318702 | 2/1920 | Germany . |
| 43 03 381 | 12/1994 | Germany . |
| 93 20 691 | 1/1995 | Germany . |
| 42 03 550 | 7/1995 | Germany . |
| 29600845 | 4/1996 | Germany . |

*Primary Examiner*—Edgar S. Burr
*Assistant Examiner*—Leslie Grohusky
*Attorney, Agent, or Firm*—Jones, Tullar & Cooper, P.C.

[57] ABSTRACT

A flexible plate is removed from the surface of a cylinder in a rotary printing press by supplying a fluid under pressure to a chamber into which the plate ends have been inserted. The fluid under pressure creates a positive pressure in the chamber which is sufficient to push at least one of the plate ends out of the chamber.

6 Claims, 5 Drawing Sheets

PLATE END EJECTOR FOR PLATE CYLINDER

FIELD OF THE INVENTION

The present invention is directed generally to a cylinder for a rotary printing press. More particularly, the present invention is directed to a flexible plate receiving cylinder of a rotary printing press. Most specifically, the present invention is directed to a plate receiving cylinder which is provided with a plate end lifting arrangement, and to a method for lifting a plate end from a cylinder. The plate receiving cylinder is provided with a flexible plate end receiving channel or slit into which the angled ends of the flexible plate are inserted. A plurality of plate end engaging pressure elements are utilized to hold the flexible plate ends in the channel or slit. When the plate ends are to be released, the pressure elements are disengaged. A fluid under pressure, such as compressed air, is directed into the plate end receiving slit and acts to force the flexible plate ends out of the slit.

DESCRIPTION OF THE PRIOR ART

In the field of rotary printing, it is generally well known to attach flexible plates to the surface of various cylinders. Such plates can be flexible printing plates, flexible blankets or other similar cylinder covers. These flexible plates may be provided with beveled or angled leading and trailing end legs which are inserted into a cylinder wide slit or channel. Since it is desirable to utilize as much of the cylinder's surface as possible for printing or other similar uses, the width of the slit or channel itself is kept as small as possible. A result of this has been an inability to easily remove the flexible plate ends from the slit into which they have been inserted. It has been necessary to resort to various tools in order to pull the plate ends from the slit. Such tools are apt to damage either the flexible plate or the cylinder.

In German document No. DE 43 03 381 A1 there is disclosed a plate cylinder that is provided with a printing plate lifting device which uses compressed air. A plurality of openings or nozzles, that can be connected to a source of compressed air, are placed on the jacket face or peripheral surface of the cylinder from which the plate is to be lifted. These openings or nozzles are situated so as to underlie the flexible plate that is to be removed.

This prior art arrangement has several limitations. Since the peripheral surface or jacket of the cylinder is provided with a plurality of openings or nozzles, it no longer presents a smooth surface. The various nozzles or openings give rise to printing irregularities. Alternatively, these openings will enlarge the area of the cylinder which is unsuitable for printing. Additionally, as air pressure is supplied to these nozzles or openings and starts to lift the plate off the surface area of the cylinder, the effective area that must be kept under high pressure will enlarge as the plate lifts away from the cylinder. This requires an increasing amount of high pressure air.

It will be apparent that a need exists for an apparatus and method for ejecting a plate end which overcomes the limitations of the prior art. The plate end ejector for a plate cylinder in accordance with the present invention overcomes these limitations of the prior art and is a substantial improvement over the prior art.

SUMMARY OF THE INVENTION

It is an object of the present invention to provide a cylinder for a rotary printing press.

Another object of the present invention is to provide a flexible plate receiving cylinder for a rotary printing press.

A further object of the present invention is to provide a plate receiving cylinder which is provided with a plate end lifting arrangement.

Still another object of the present invention is to provide a flexible plate receiving cylinder utilizing a fluid pressure to lift a plate off the peripheral surface of the cylinder.

As will be discussed in detail in the description of the preferred embodiment which is presented subsequently, the plate receiving cylinder in accordance with the present invention is provided with a thin slit which can receive the angled or bent ends of the flexible plate. This slit is directed generally radially inwardly into the body of the cylinder. A plurality of pressure elements, such as spring-biased balls or cams are engageable with the flexible plate ends and act to clamp the plate ends in the slit. Once the plate ends have been released by the pressure elements, they must be forced out of the slit. This is accomplished by supplying a fluid, such as air, under pressure to the slit. This pressurized fluid can be supplied through a fluid pressure supply line that is located in the slit or adjacent to the slit. The pressurized fluid acts against the flexible plate ends and forces them out of the slit.

One advantage of the present invention over the prior art is that it does not require tools to engage either the flexible plate or the cylinder. There is no likelihood of damage being caused to either the plate, its ends, or to the cylinder.

Another benefit of the present invention is that the pressurized fluid, such as compressed air, is supplied only to the small area of the plate end receiving slit. This greatly reduces the amount of compressed air needed to free the plate ends. It also eliminates the cylinder periphery or surface situated openings or nozzles and thus provides a smooth, uniform cylinder surface.

The amount of pressurized fluid, such as compressed air that is required is, as indicated above, kept at a minimum. Since there are few openings through which this pressurized air can escape while the plate ends are being forced out of the cylinder slit, only a minimal amount of compressed air is required. This allows the pressure fluid supply lines to be relatively small in cross-section so that they do not require a great deal of space in the cylinder. Compressed air costs are decreased as is the noise level since less compressed air is vented. One end of the flexible plate can be easily and quickly completely removed from the flexible plate end receiving slit. The supply lines for the compressed air are kept very simple and maintenance free.

The plate end ejector for a plate cylinder in accordance with the present invention overcomes the limitations of the prior art. It is a substantial advance in the art.

BRIEF DESCRIPTION OF THE DRAWINGS

While the novel features of the plate end ejector for a plate cylinder in accordance with the present invention are set forth with particularity in the appended claims, a full and complete understanding of the invention maybe had by referring to the detailed description of the preferred embodiments, which is presented subsequently, and as illustrated in the accompanying drawings, in which:

DETAILED DESCRIPTION OF THE PREFERRED EMBODIMENTS

Figure 1:
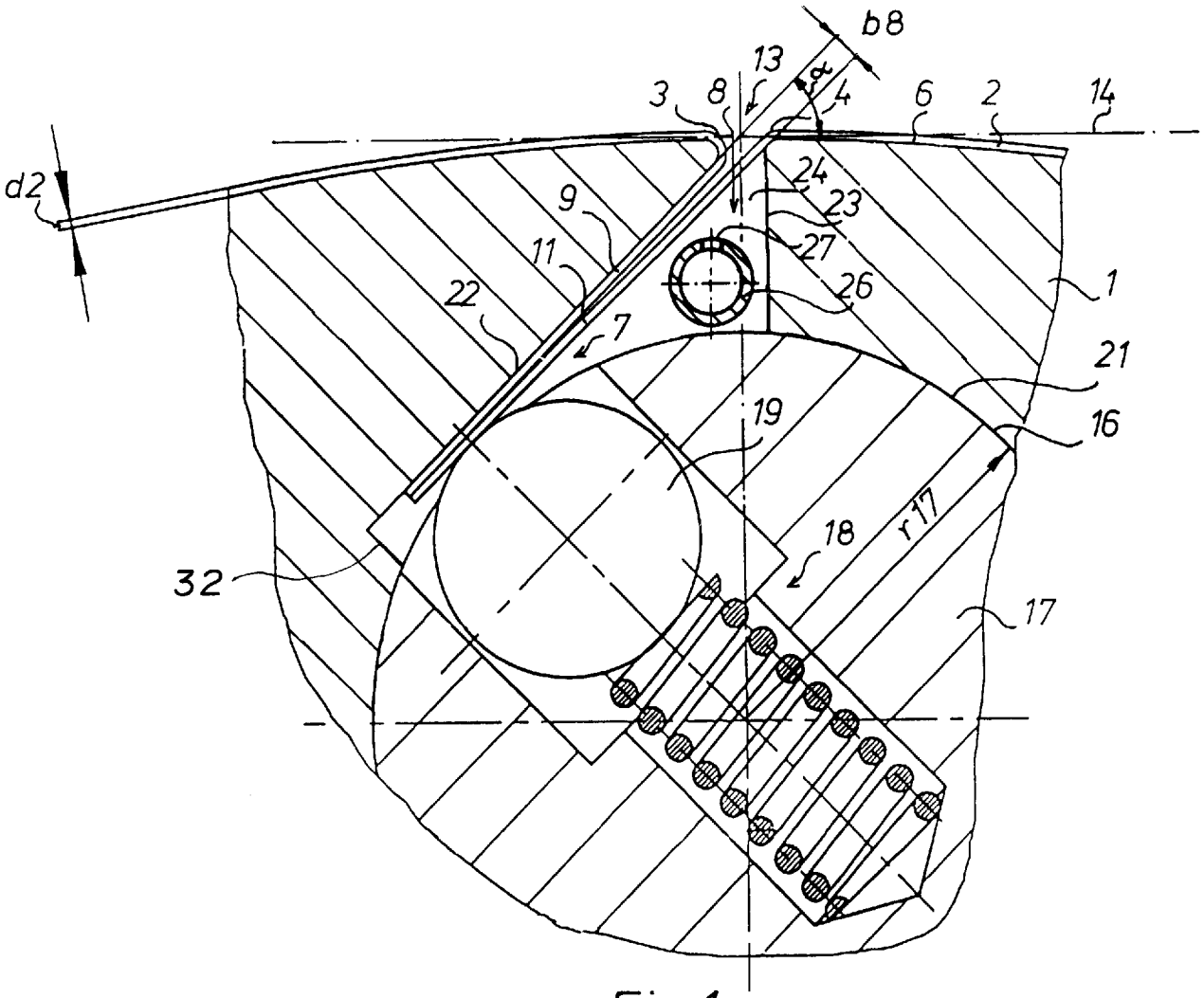
FIG. 1 is a schematic cross-sectional view through a portion of a cylinder and showing a first preferred embodiment of the plate end ejector in accordance with the present invention.

Referring initially to FIG. 1 of the drawings, there may be seen at 1 a portion of a cylinder which is a part of a rotary printing press and in which the plate end ejector in accordance with the present invention is situated. It will be understood that cylinder 1 is a plate cylinder that forms part of a rotary printing press. Cylinder 1 could also be a resilient blanket cylinder or another type of cylinder which is utilized in a rotary printing press. The overall structure of the cylinder 1 and of the rotary printing press form no part of the subject invention and are thus not described in detail.

Cylinder 1 is structured to receive flexible printing plates 2 on its peripheral surface 6 and is provided with at least one axially extending, generally radially inwardly directed thin slit 8 that extends generally radially inwardly into cylinder 1 from a slit outer end 13 at the surface 6 of the cylinder into the cylinder interior 7. The flexible printing plate 2, that is situated on the surface 6 of the cylinder 1, is provided with leading and trailing beveled or angled ends, generally at 3 and 4, respectively. As may be seen in FIGS. 1–5, these leading and trailing beveled plate ends 3 and 4 have leading and trailing legs 9 and 11 respectively which are receivable in narrow slit 8 when flexible plate 2 is positioned on the surface 6 of the cylinder 1.

The flexible plate 2 has a plate thickness d2 of for example, d2=0.3 mm This plate, as discussed above, is preferably a printing plate. It may also be a support plate with a rubber blanket fastened to it, or may be another type of plate usable in a rotary printing press. As discussed previously, the leading end 3 of the plate has a leading end leg 9 while the trailing end 4 has trailing end leg 11.

In the plate cylinder depicted in FIGS. 1–3 and 5, the cylinder slit 8 has a generally triangular shape in the interior 7 of the cylinder 1. This slit or conduit 8 can also be generally rectangular in cross-sectional shape, as may be seen at 12 in FIG. 4. The cylinder slit or conduit 8 or 12 has at its outer end 13 a width b8 which is only slightly greater than twice the thickness d2 of the plate 6. Thus slit width b8 is equal to approximately 1 mm The conduit or slit 8 or 12 is inclined at an angle $\alpha$ of inclination a of generally 45° with respect to a line 14 which is tangent to the peripheral surface 6 of the cylinder 1 at the location of the slit or conduit 8 or 12.

An axially extending bore 16 is formed in the cylinder 1 and extends parallel with the cylinder slit 8. An inner end of the slit 8 or 12 is in contact with the bore 16 and forms a chord with respect to the bore 16. In the subject invention, the bore 16 is in contact with the inner end 32 of the conduit or slit 8 or 12.

A pivot lever 17 which, in the subject invention, is configured as a spindle 17 having a radius r17 of, for example, r17=15 mm, is seated in the bore 16. The pivot lever or spindle 17 is centered in the cylinder bore 16 and is rotatable with respect to the cylinder 1 in the bore 16. A plurality of radially outwardly acting pressure elements, generally at 18, are axially spaced along the length of the spindle 17. These pressure elements 18 are secured in the spindle 17 in such a way that pressure cams 19, which are part of the pressure elements 18, can resiliently act or extend radially outwardly beyond a circumferential surface 21 of the spindle 17. Each of these pressure cams 19 may be provided with a ball or generally rounded end cap at its radially outer end. Other end shapes, such as cylinder segments, are also possible. Each pressure cam 19 forms a contact zone, which may be, for example, linear with the surface of the plate end which it contacts, as seen in FIG. 1.

In accordance with the first preferred embodiment of the present invention, as may be seen in FIG. 1, the flexible plate end receiving slit 8, which is generally triangular in cross-sectional shape within the interior 7 of the cylinder 1, receives the leading and trailing end legs 9 and 11 of the plate leading and trailing ends 3 and 4. A first side face 22 of slit 8 defines the hypotenuse of the triangular area or chamber 24 formed by the slit 8. A second side face 23 of chamber 24 is opposite to the first side face 22 and is generally perpendicular to the tangent line 14. This second side face 23 thus extends in the radial direction of the cylinder 1. The third side of the triangular space 24 is defined by the peripheral surface 21 of the pivot lever or spindle 17. A pressure fluid supply line 26, which may be in the form of a flexible tube or hose 26, that is generally circular in cross-section, is located in this triangular space 24. This pressure fluid supply line 26 extends across the width of cylinder 1 generally parallel to the axial length of pivot lever or spindle 17. While not specifically shown in the drawings, it will be understood that pressurized fluid supply line 26 can be connected at at least one end to a source of pressurized fluid, such as compressed air. A suitable rotary coupling could be utilized to form such a connection so that pressurized fluid can be supplied to pressure fluid supply line 26 during rotation of cylinder 1. Alternatively, it would also be possible to connect pressure fluid supply line 26 to a source of pressurized fluid only while cylinder 1 is stationary. It will also be understood that the axially spaced ends of chamber 24 could be closed, if desired.

As may be seen in FIG. 1, the pressure fluid supply line 26 is provided with a plurality of axially spaced outlet openings 27. These outlet openings 27 are situated in supply line 26 so that they face into, and thus will direct fluid under pressure into the chamber 24.

Figure 2:
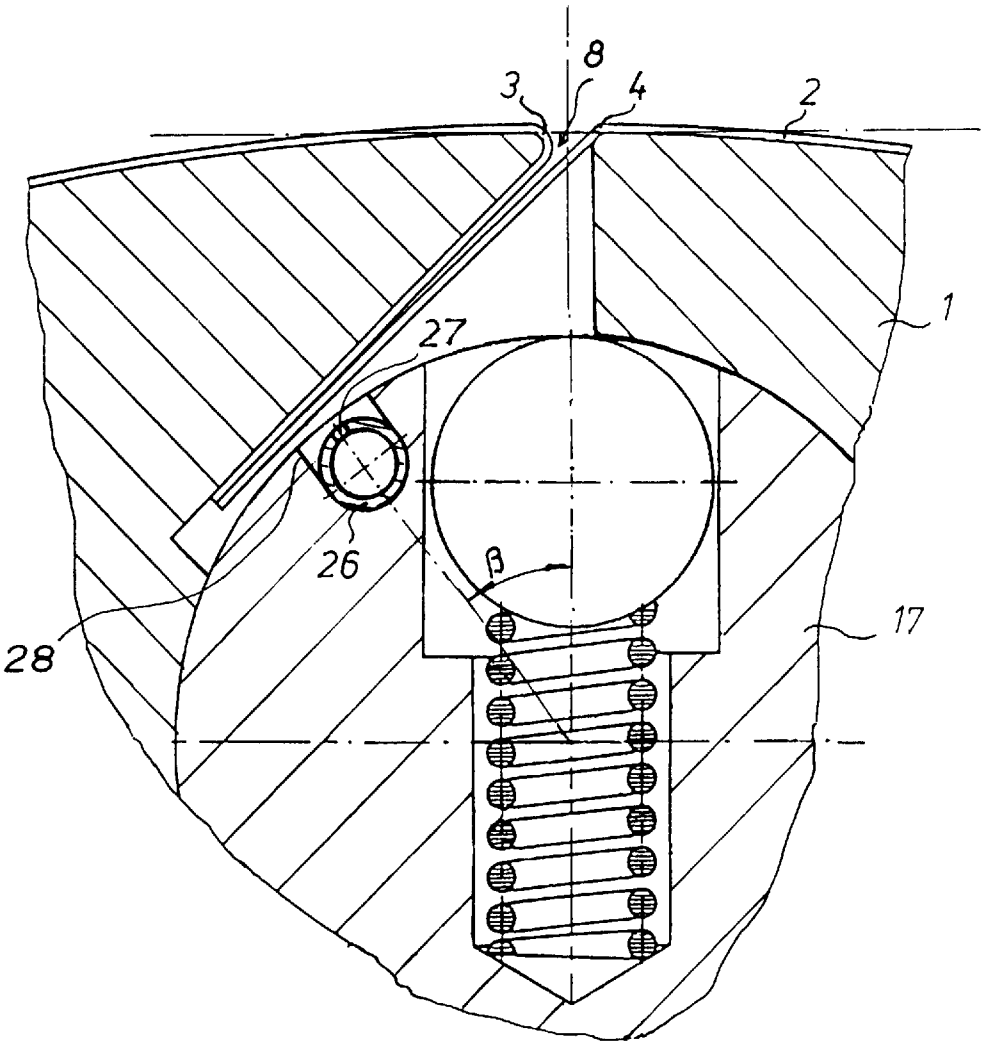
FIG. 2 is a schematic cross-sectional view of a second preferred embodiment of the invention.

Referring now to FIG. 2, there may be seen a second preferred embodiment of the plate end ejector for a plate cylinder in accordance with the present invention. In this second preferred embodiment, the pressure fluid supply line 26 is again a tube which now is situated in the pivot shaft 17. The shaft 17 has an axially extending, generally U-shaped channel 28 which is disposed at the peripheral surface 21 of the pivot shaft 17. This U-shaped channel 28 opens radially outwardly and is sized to accommodate the pressure fluid supply line or hose 26. When the pivot shaft 17 is rotated to its plate end unclamping position, as depicted in FIG. 2, the U-shaped channel 28 and the pressure fluid supply line 26 will be situated in the generally triangular shaped chamber 24 with the outlet openings 27 in the pressure fluid supply line 26 directed into the chamber 24. This will allow fluid under pressure to fill the chamber 24 and to thus force the flexible plate ends 3 and 4 out of the slit 8. The opening angle $\beta$ between the axis of the pressure elements 18 and the U-shaped channel 28 is shown in FIG. 2. This opening angle may be 35°.

Figure 3:
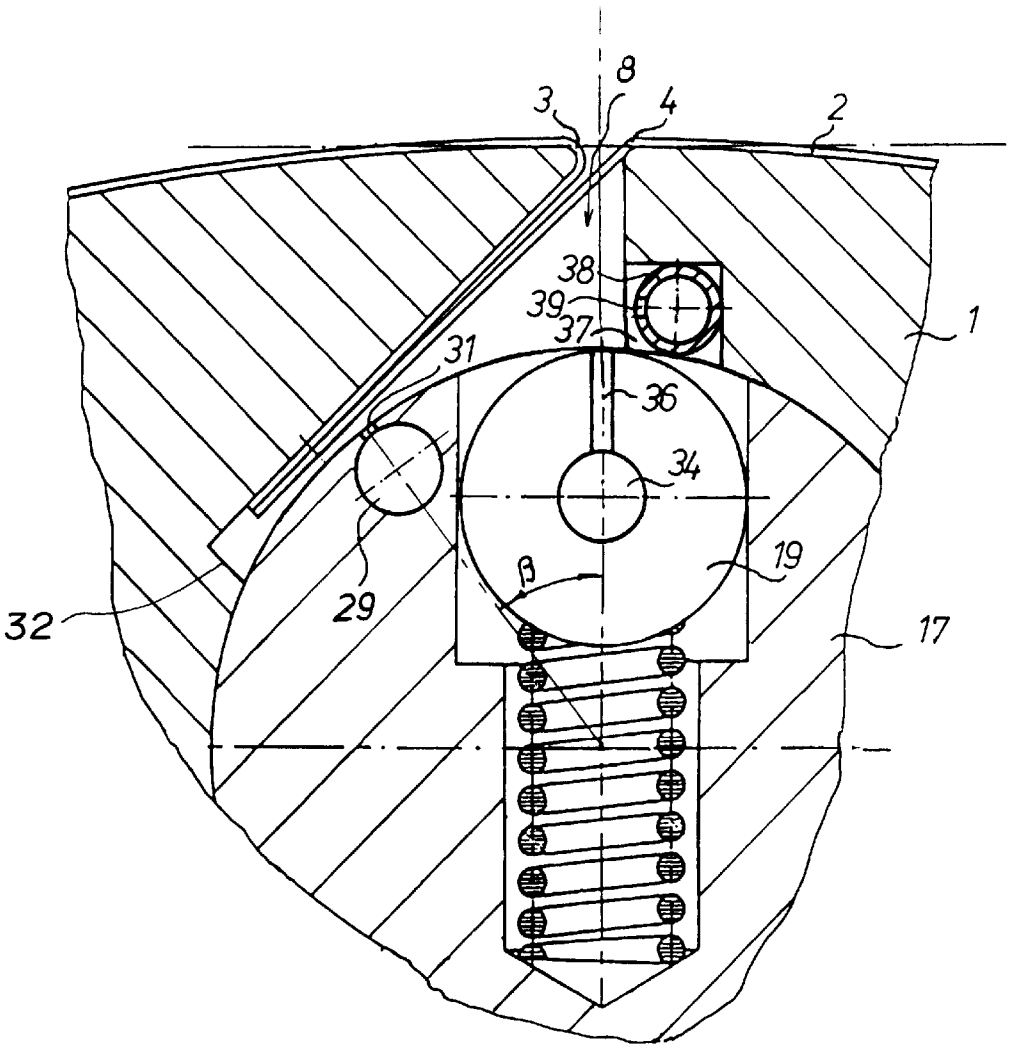
FIG. 3 is a schematic cross-sectional view of a third preferred embodiment of the invention.

In a third preferred embodiment of the present invention, as is depicted in FIG. 3, the pressure fluid supply line can also be integrated into the pivot shaft 17. This may be accomplished by providing pivot shaft 17 with an axially extending bore 29 which, as seen in FIG. 3 underlies the peripheral surface 21 of shaft 17. This bore 29 is provided with a plurality of axially spaced outlet openings 31 that will direct fluid under pressure into the chamber 24 when the pivot shaft 17 is in its unclamped position, in a manner similar to that described in connection with FIG. 2.

In addition to, or in lieu of, the bore 29 integrated into the pivot shaft 17, the pressure cams 19 of the pressure element 17 can each be provided with a central bore 34 with each such central bore 34 being aligned generally with the axis of rotation of pivot shaft 17. Each such central bore 34 in each pressure cam 19 will be in fluid connection with chamber 24 through one or more outlet openings 36 when the pivot shaft is rotated to its plate end unclamping position, as depicted in FIG. 3. The central bores 34 in each of the axially spaced pressure cams 19 can be interconnected by a flexible tube or hose that extends along the axial direction of pivot shaft 17. It is also possible, in addition to, or in substitution for the bore 29 and the central bore 34 to dispose a tube 38, which is provided with a plurality of outlet openings 39 that face into the chamber 24, in a recess 37 which is formed in the second side face 23 of the cylinder slit 8.

Figure 4:
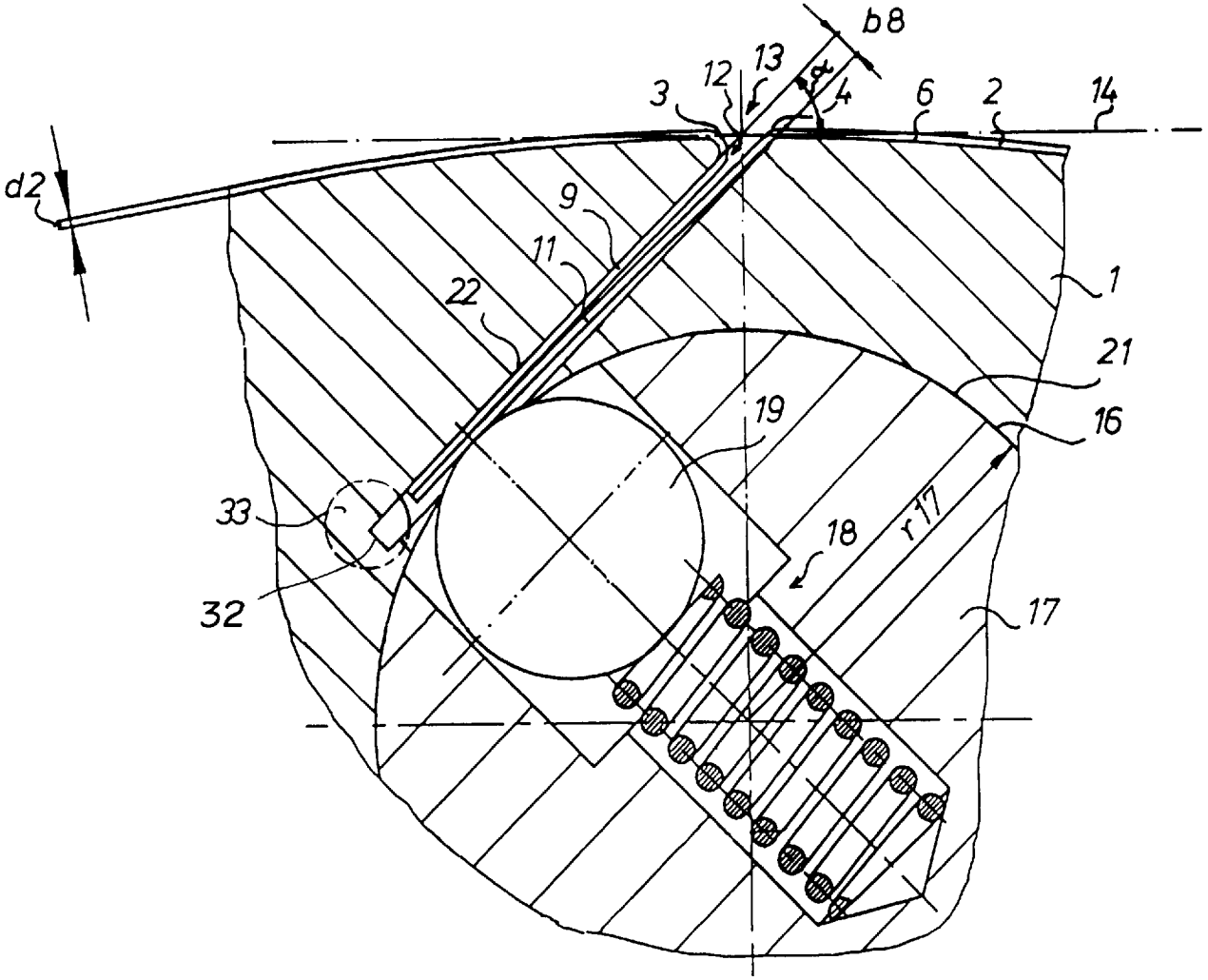
FIG. 4 is a schematic cross-sectional view of a fourth preferred embodiment.

Turning now to FIG. 4, there may be seen a fourth preferred embodiment of a plate end ejector for a plate cylinder in accordance with the present invention. In this fourth preferred embodiment, it will initially be noted, as had been discussed previously, that the cylinder slit 12 is generally rectangular in cross-section. The interior slit end 32 is closed at its two cylinder end faces and each end face can be provided with an inlet bore 33, as depicted in dashed lines in FIG. 4. Each of these inlet bores 33 can be connected to a pressure fluid source so that the cylinder slit 12 will act as the pressure fluid supply line. It would also be possible to enlarge the slit inner end 32 and to situate a separate pressure fluid supply line, such as a flexible hose 26 in this enlarged cylinder slit inner end 32. The flexible hose 26 would, as was depicted in FIGS. 1 and 2 be provided with axially spaced outlet openings 27 so that the fluid under pressure would be directed into the interior of the cylinder slit 12.

Figure 5:
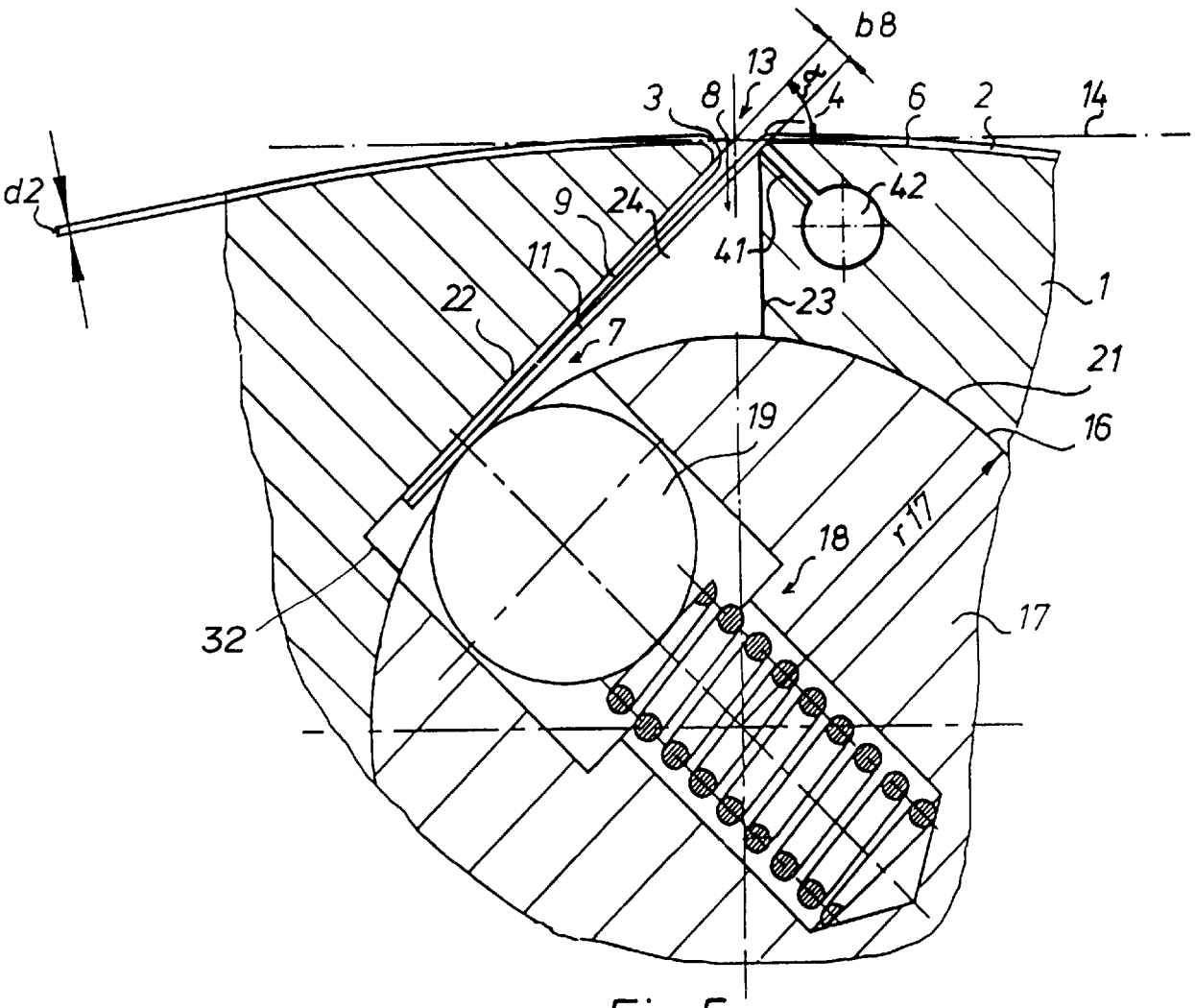
FIG. 5 is a schematic cross-sectional view of a fifth preferred embodiment of a plate end ejector in accordance with the present invention.

As shown in FIG. 5 in a fifth preferred embodiment of a plate end ejector for a plate cylinder in accordance with the present invention, a pressure fluid supply line is provided in the form of an axially extending cylinder bore 42 that is disposed underlying the peripheral or jacket surface 6 of the cylinder 1. This outer cylinder bore 42 is provided with suitable end couplings, that are not specifically shown, to a source of pressurized fluid. The pressurized fluid is fed along the pressure fluid supply line 42 and is directed into chamber 24 through a plurality of outlet openings 41 which extend between the chamber 24 and the fluid pressure supply lien 42. As may be seen in FIG. 5, these outlet openings terminate in chamber 24 generally in the rounded or circumferential transition area where the second or trailing chamber side wall 23 joins the peripheral or jacket surface 6 of the cylinder 1. The pressurized fluid, which is directed out through the outlet openings 41 from the pressure fluid supply line 42, thus acts on the plate 2 in the region of the plate trailing end leg 11 where leg 11 joins the body of the plate 2.

It would also be possible, in the situation of a cylinder 1 that carries a plurality of axially spaced plates 2 on its peripheral surface 6, to provide a number of separate pressure fluid supply lines 26 along the length of the cylinder 1. Each such pressure fluid supply line 26 would then be associated with the separate cylinder slit 8 or 12 which receives the leading and trailing ends of the flexible plate 2 associated with that slit 8 or 12. This would facilitate the removal of the plate ends of only the individual plate 2 to be removed from the cylinder 1 without disturbing the other plates also carried by the cylinder 1. In this situation, the cylinder slit 8 or 12 is also preferably subdivided into several slit segments with each such segment having its own pressure fluid supply line. The subdivision of the cylinder slit 8 or 12 into several segments would result in the formation of several segments of the cylinder chamber 24.

In accordance with the several preferred embodiments of the present invention, the sum of the areas of the outlet openings of the pressure fluid supply line or lines should be greater than the sum of the areas of the secondary openings through which the pressurized fluid, supplied through the outlet openings, can escape. One such secondary opening through which air can escape is the narrow gap that is formed between the two legs 9 and 11 of the plate 2. This gap is necessary in order to insure that the plate ends 9 and 11 will fit in the cylinder slit 8 or 12. Since the area of the secondary openings is preferably kept less than the area of the outlet openings in the pressure fluid supply line, there should be generated a positive pressure in the chamber 24 to insure that the plate ends will be ejected.

The operation of the plate end ejector for a plate cylinder is as follows. To remove a plate 2 from the surface 6 of the cylinder 1, the pivot shaft 17 is rotated in a clockwise direction from its plate end clamping position, as seen in FIGS. 1, 4 and 5, to its plate end unclamped position, a seen in FIGS. 2 and 3. In the plate end unclamped position, the pressure cams 19 are disengaged from the plate end leg 11 so that the plate end legs 9 and 11 are retained in cylinder slit 8 or 12 only by frictional forces due to their engagement with the side faces of the slit 8 or 12. The pressure cams 19 now engage the face of the cylinder bore 16 in which the pivot spindle is situated. With the pivot shaft 17 in the plate end unclamped position, fluid under pressure is directed to the pressure fluid supply line. The fluid under pressure is directed into chamber 24 formed in the cylinder interior 7 by the cylinder slit 8 or 12. This fluid under pressure pressurizes the chamber 24 and thus exerts a pressure force on the plate end legs 9 and 11 and slides these plate end legs 9 and 11 out of the cylinder slit 8. The pressurized fluid is supplied to the chamber 8 for a sufficient length of time to insure that at least one of the flexible plate end legs 9 or 11 will be completely slid out of the cylinder slit 8 or 12.

While preferred embodiments of a plate end ejector for a plate cylinder of a rotary printing press in accordance with the present invention have been set forth fully and completely hereinabove, it will be apparent to one of skill in the art that changes in, for example, the overall size of the cylinder, the source of the fluid under pressure, the drive for the cylinder and spindle and the like can be made without departing from the true spirit and scope of the present invention which is accordingly to be limited only by the following claims.

What is claimed is:

1. A plate end ejector for a plate cylinder in a rotary printing press comprising:

a plate cylinder having a plate cylinder body;

a peripheral surface on said plate cylinder body;

a bore formed within said plate cylinder, said bore being defined by a face portion of said plate cylinder body; said bore being capable of receiving a rotatable pivot shaft;

a flexible plate end receiving slit in said plate cylinder body, said flexible plate end receiving slit extending generally radially inwardly into said plate cylinder body from said peripheral surface and defining a plate end receiving chamber in said plate cylinder body;

a pressure fluid supply line in said plate cylinder body and in fluid communication with said plate end receiving chamber; and at least one pressure fluid outlet opening extending within said plate cylinder body between said pressure fluid supply line and said plate end receiving chamber defined in said plate cylinder body by said flexible plate end receiving slit.

2. The plate end ejector of claim 1 further including a printing plate receivable on said peripheral surface.

3. The plate end ejector of claim 1 wherein said pressure fluid supply line is an axially extending conduit disposed in said flexible plate end receiving slit in said plate cylinder body, said axially extending conduit having a plurality of said outlet openings.

4. The plate end ejector of claim 1 wherein said flexible plate end receiving slit in said plate cylinder body is generally rectangular in cross-section and has an interior slit end and wherein said at least one outlet opening is disposed in said interior slit end.

5. The plate end ejector of claim 1 wherein said pressure fluid supply line is located in said plate cylinder body between said face portion of said plate cylinder body and said peripheral surface.

6. A method for ejecting a plate end from a jacket surface of a cylinder in a rotary printing press including:

providing a cylinder having a cylinder body;

providing a peripheral surface on said cylinder body;

providing a bore formed within said cylinder, and defining said bore by a face portion of said cylinder body and further adapting said bore to receive a rotatable pivot shaft;

providing a plate end receiving slit in said cylinder body extending generally radially inwardly into said cylinder body from said peripheral surface;

defining a plate end receiving chamber in said cylinder body including said plate end receiving slit;

providing a pressure fluid supply line in said cylinder body;

providing at least one pressure fluid supply opening extending within said cylinder body between said pressure fluid supply line and said plate end receiving chamber;

supplying fluid under pressure to said plate end receiving chamber from said pressure fluid supply line through said at least one pressure fluid supply opening;

generating a positive pressure in said plate end receiving chamber; and causing ejection of said plate end from said plate end receiving slit by said positive pressure generated in said plate end receiving chamber.

* * * * *